US006102248A

United States Patent [19]

Yamamiya

[11] Patent Number: 6,102,248

[45] Date of Patent: Aug. 15, 2000

[54] CARD TYPE STRUCTURES

[75] Inventor: Takahito Yamamiya, Saitama, Japan

[73] Assignee: Asahi Seiko Co., Ltd., Tokyo, Japan

[21] Appl. No.: 09/120,910

[22] Filed: Jul. 22, 1998

[30] Foreign Application Priority Data

Jul. 23, 1997 [JP] Japan ..... 9-228772
Jul. 23, 1997 [JP] Japan ..... 9-228773

[51] Int. Cl.[7] ..... B23Q 7/04; B65H 3/08

[52] U.S. Cl. ..... 221/211; 221/232; 221/227; 221/279; 271/11; 271/30.1; 271/107; 271/155; 414/797

[58] Field of Search ..... 271/11, 107, 30.1, 271/31, 155, 157, 162; 221/211, 232, 227, 230, 278, 279; 414/796.7, 796.9, 797

[56] References Cited

U.S. PATENT DOCUMENTS

| | | | |
|---|---|---|---|
| 2,538,238 | 1/1951 | Evans | 271/232 |
| 3,199,863 | 8/1965 | Muller | 414/797 |
| 4,175,676 | 11/1979 | Renaud et al. | 221/211 |
| 4,556,210 | 12/1985 | George | 271/162 |
| 4,993,587 | 2/1991 | Abe . | |
| 5,116,037 | 5/1992 | Gerlier et al. . | |
| 5,441,246 | 8/1995 | Miyata et al. | 271/162 |
| 5,803,447 | 9/1998 | Singer et al. | 271/11 |

FOREIGN PATENT DOCUMENTS

| | | |
|---|---|---|
| 5964437 | of 0000 | Japan . |
| 597258 | of 0000 | Japan . |

OTHER PUBLICATIONS

Asahi Seiko USA, Inc.; General Catalog No. 0705AS1 (1997) (4 pages).

Habich et al, Document Elevating Hopper, IBM Technical Disclosure Bulletin, vol. 17 No. 7, p. 1848, 1974.

*Primary Examiner*—H. Grant Skaggs
*Attorney, Agent, or Firm*—Price Gess & Ubell

[57] ABSTRACT

A dispensing apparatus module for a vending machine is provided that enables stacked articles to be lifted off of the stack and translated from a loading station to a discharge station. An elevator apparatus is provided for progressively moving articles to a load station. A conveying apparatus with a linkage assembly for supporting a section nozzle can contact the uppermost article and lift it off the stacked array. The conveying apparatus can move the article to a discharge station for releasing the article to the user. A self-contained suction source is provided in the dispensing apparatus to provide low atmospheric pressure to the suction nozzle.

19 Claims, 9 Drawing Sheets

CARD TYPE STRUCTURES

BACKGROUND OF THE INVENTION

1. Field of the Invention

The present invention is directed to the discharging of relatively flat rectangular structures, such as a packaged IC card without damaging the integrated circuit portion or any transparent film that is protecting the IC card member, and the ability to provide a discharge apparatus in a dispenser unit that can be easily recharged by an operator.

2. Background of the Invention

Vending machines that have been capable of dispensing card bodies are known in the prior art. For example, Asahi Seiko, U.S.A., Inc. has disclosed various configurations of card dispensers that prevent the dispensing of two cards continuously or two cards stuck together, such as in a Model CD200 wherein a reverse roller can prevent the dispensing of two cards that may be adhered together.

An example of a discharge apparatus for cards is disclosed in the Japanese Utility Patent No. 63-60147 and U.S. Pat. No. 4,993,587. This disclosure teaches the dispensing of cards using a rubber roller in order to discharge relatively thin cards, such as, telephone debit cards. The conventional discharge apparatus are mainly directed for discharging thin cards with a gravity feeding of the thin cards to a discharge or ejector mechanism. Such structures are not readily applicable to discharging a relatively thick IC card, a card with a packaged description, a plate-shaped box, etc. Conventional apparatus which use a rotating rubber roller for contacting and extending across the surface of the card has its limitations in that some structures can be damaged by such a discharge or ejection mechanism.

The prior art is still seeking dispensing apparatus that can handle thick IC cards, cards with package description, plate-shaped box and other stored objects which should not be subjected to frictional forces that would extend across the surface of the object.

SUMMARY OF THE INVENTION

The present invention provides a dispensing apparatus module for dispensing articles in a stacked array in a vending machine. The dispensing apparatus is relatively narrow and efficiently uses the available space in the vending machine. The dispensing apparatus includes an elevator assembly that can movingly support a stacked array of articles so that the articles are lifted upward to a loading station where they can be grasped by a conveying apparatus and translated to a discharge station. The elevator apparatus can have a housing with a flat surface for supporting the stacked articles. A motor can appropriately drive, through a transmission assembly, driven members to engage a track for raising the elevator apparatus. An operator can activate a lever that can disengage the transmission assembly and permit the elevator assembly to be released from the track and to be positioned at its lowest position for receiving a new charge of stacked articles. One sensor can determine the status of articles on the elevator assembly, while another sensor can determine the lack of articles on the elevator assembly and thereby provide a shut-down signal to warn a user that the vending machine is empty.

At a top portion of the dispensing apparatus module, a conveying apparatus includes a linkage assembly that is connected to a suction nozzle. The linkage assembly can be extended by a camming member against the bias of springs to extend the suction nozzle to contact the uppermost stacked article and to adhere to the article. The linkage assembly can then be retracted to lift the article off the stacked array. Thus, the article is not subject to any frictional forces relative to the other articles in the stack. A conveyor belt can contact the conveying apparatus and move it from the load station to a discharge station. The suction nozzle can then release the article so that it is then dispensed to a dispensing tray for the user. A band spring is attached to the conveying apparatus, and when the belt conveyor releases the conveying apparatus, the band spring can then be retracted to pull the conveying apparatus from the discharge station to the load station. The belt conveyor can have a protrusion to appropriately time the movements of the conveying apparatus at the load station and the translation of the conveying apparatus to the discharge station.

A self-contained suction source includes a rack rod that can be driven by a motor against spring biased pistons that are journaled within cylinders to provide a suction force when the rack rod is released. The suction forces are conveyed by appropriate conducts to the suction nozzle on the linkage assembly.

BRIEF DESCRIPTION OF THE DRAWINGS

The objects and features of the present invention, which are believed to be novel, are set forth with particularity in the appended claims. The present invention, both as to its organization and manner of operation, together with further objects and advantages, may best be understood by reference to the following description, taken in connection with the accompanying drawings:

DETAILED DESCRIPTION OF THE PREFERRED EMBODIMENTS

The following description is provided to enable any person skilled in the art to make and use the invention and sets forth the best modes contemplated by the inventor of carrying out his invention. Various modifications, however, will remain readily apparent to those skilled in the art, since the general principles of the present invention have been defined herein specifically to provide a discharge apparatus for card type structures.

Figure 1:
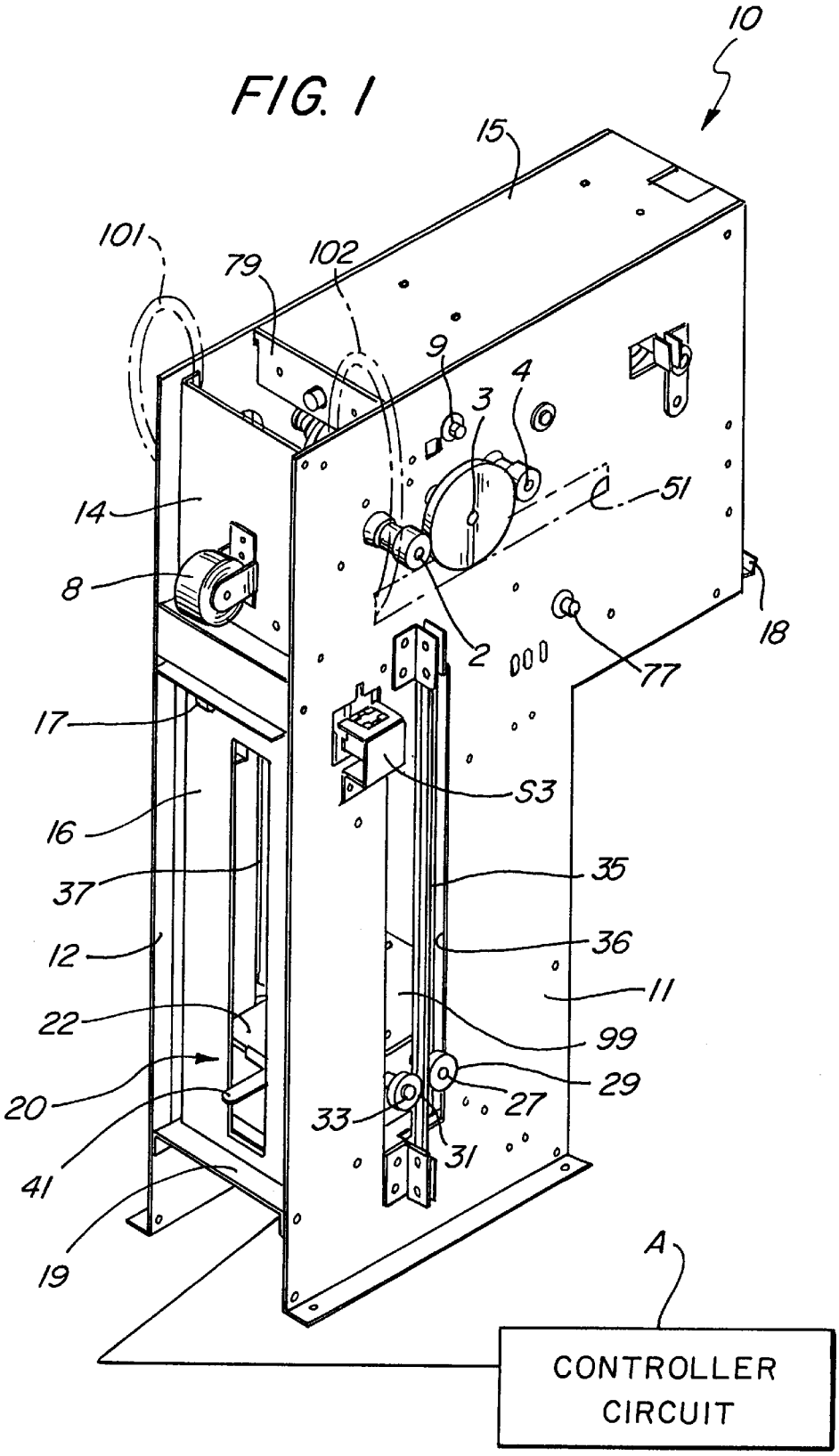
FIG. 1 is a prospective view of a rare perspective of one form of the present invention.

Referring to FIG. 1, a dispensing apparatus module 10 of the present invention is disclosed in a configuration that it is not much wider than the articles or objects to be dispensed. The dispensing apparatus module can be mounted in a vending machine. An elevator arrangement is provided that incorporates a self-driven lift mechanism that is monitored by appropriate sensors to thereby drive one or more relatively thick card-like objects upward to a loading station. Mounted adjacent to the loading station is a suction nozzle assembly that can selectively contact and adhere to an object to be dispensed. The object is removed from its stack and lifted upward. A conveyor mechanism can then selectively convey the article when it is removed from the elevator structure and deposit it in a dispensing chute, when a suction nozzle mechanism releases the article. The suction mechanism is then returned from the discharge station to the load station so that it is in a state of readiness for dispensing the next article. Mounted above the conveying mechanism is a self-contained structure for generating a suction force to be applied to the suction nozzles.

The articles to be dispensed, for example, can be integrated circuit or IC cards with instructions wrapped in a transparent envelope having a thickness within the range of 0.5 millimeter to 3.0 millimeters, the cards generally being within a range of 1.5 millimeters to 2.0 millimeters.

Figure 2:
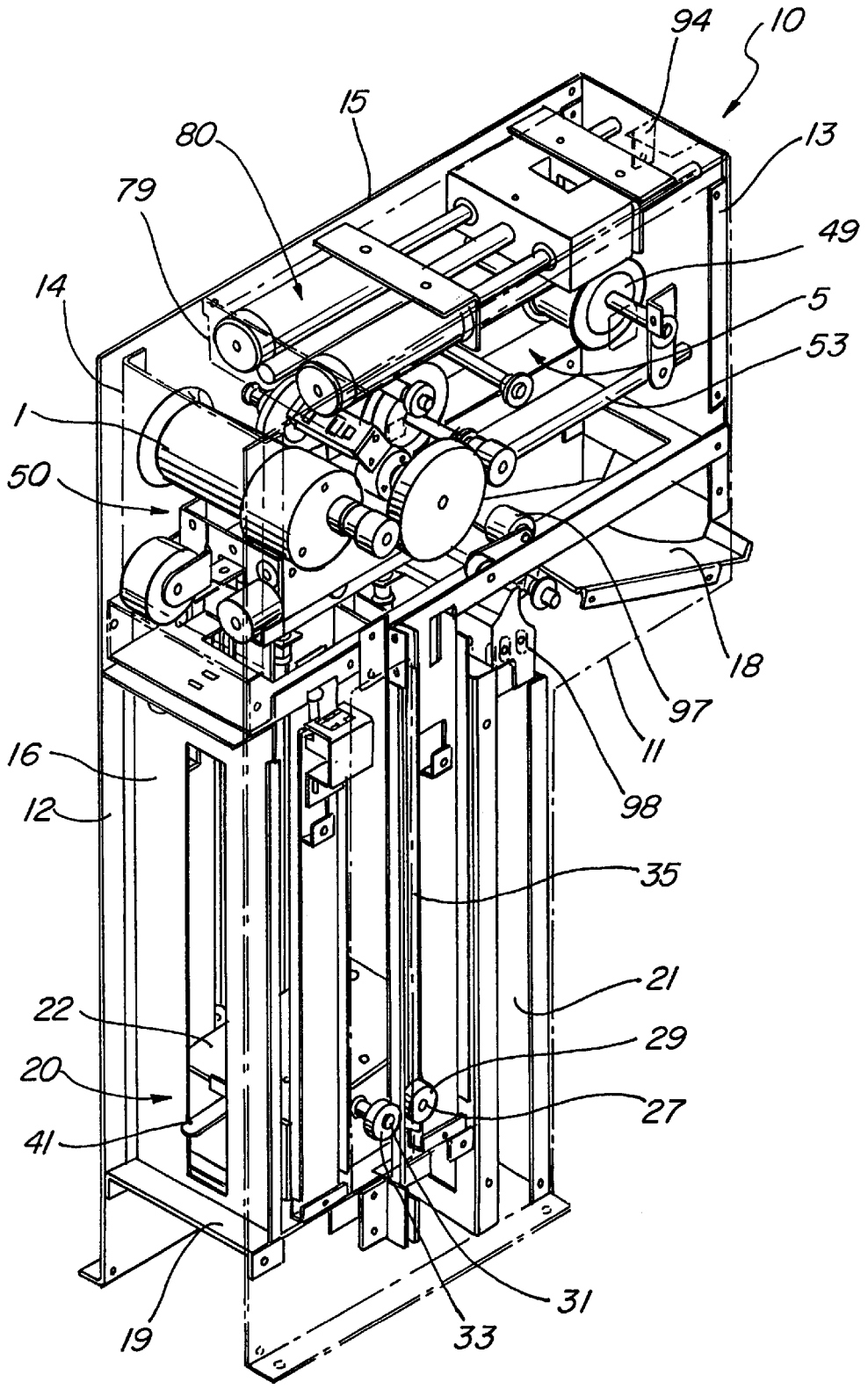
FIG. 2 is a perspective view with a portion of the housing in FIG. 1 being rendered transparent.
Figure 3:
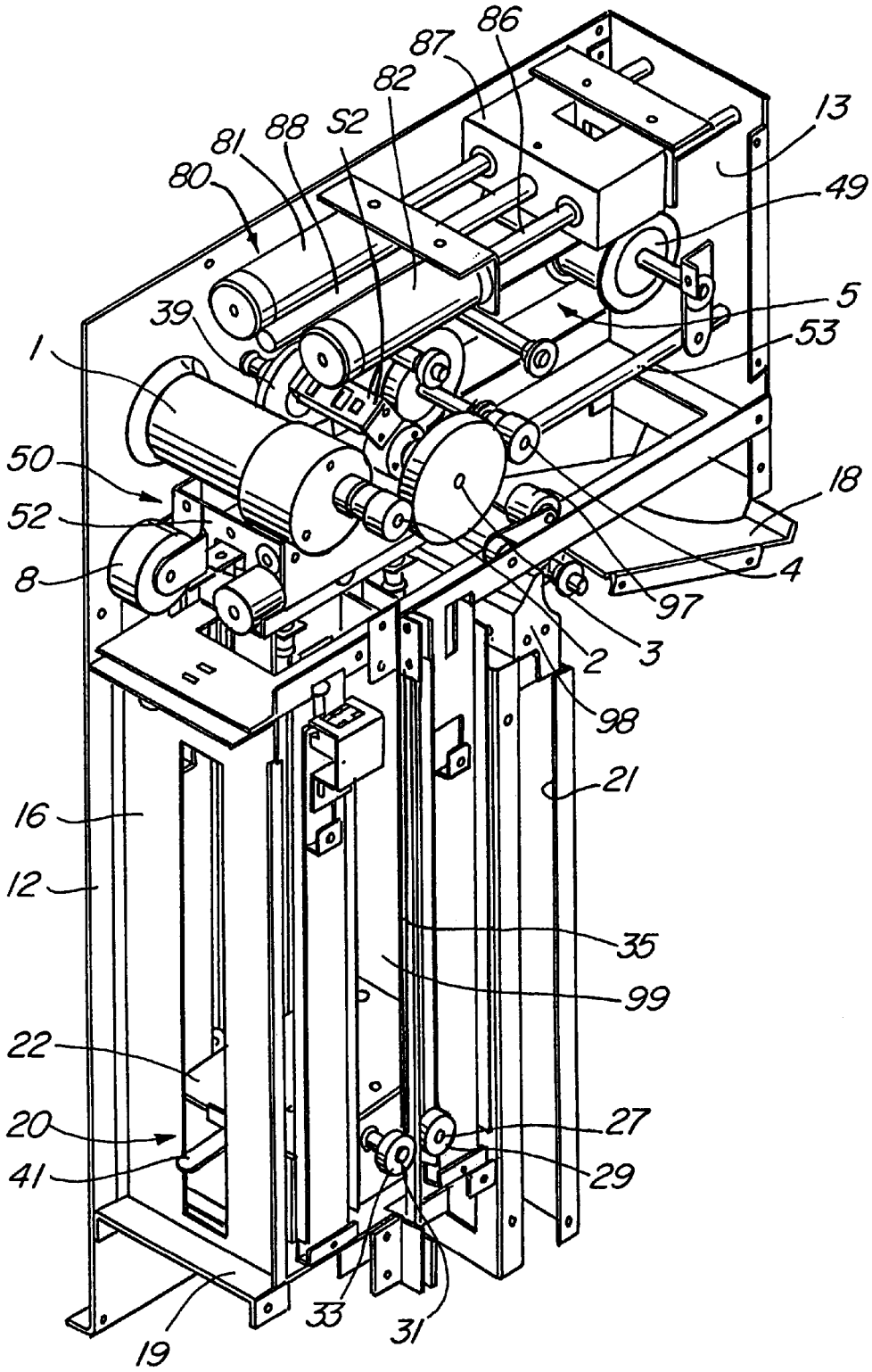
FIG. 3 is a another perspective view of FIG. 1 having a portion of the parameter wall of FIG. 1 removed.

The dispensing apparatus 10 of the present invention has a pair of parallel side plates or boards 11, 12 of an inverted L-shaped configuration. A rectangular back plate or board 14 connects the upper portion of the side plates 11, 12 while a top plate 15 extends across their upper surface to form a housing structure. As can be seen in FIGS. 1 to 3, a frontboard plate 13 extends across the front of the dispensing apparatus 10 and above a dispensing chute or receptacle 18 that will receive an article to be dispensed. A cover member or door 16 can be removed from its insertion into the bottom board 19 and can be held in position by a spring biased lock 17. As will be subsequently described, the dispensing apparatus can be recharged by removing the door 16 which has a long rectangular configuration thereby permitting access to the support surface of the elevator housing or case member 22. Articles, such as card bodies of some thickness can be appropriately stacked on top of the support surface on the elevator housing 22.

The elevator apparatus 20 is arranged in the lower portion of the housing. The elevator apparatus internal working mechanisms can be seen more fully in FIG. 7. The elevator apparatus 20 can be driven along rails or rack boards 34, 35 to thereby lift or elevate the stack of card bodies or articles that are to be dispensed. In FIG. 1, a drive roller 27 and an idler roller 33 are positioned on either side of the track or rack board 35.

The cover member or door 16 has a vertical elongated rectangular slot with a lever 41 extending through the slot. Lever 41 can be manually controlled by an operator servicing the dispensing machine 10. When the operator wants to refill the dispensing machine 10, lever 41 can be used to release the elevator apparatus 20 so that it will fall by gravity to its lowest position thereby permitting the operator to stack the objects or articles to be dispensed onto the upper surface of the elevator housing 22. The operator can then readjust the lever 41 to set it in engagement with the transmission for driving upward and the elevator apparatus 20 will drive upward until a sensor S1, see FIG. 4, senses the position of the uppermost object to be dispensed. The elevator apparatus 20 is then stopped with the uppermost article being adjacent a loading station for dispensing.

Figure 7:
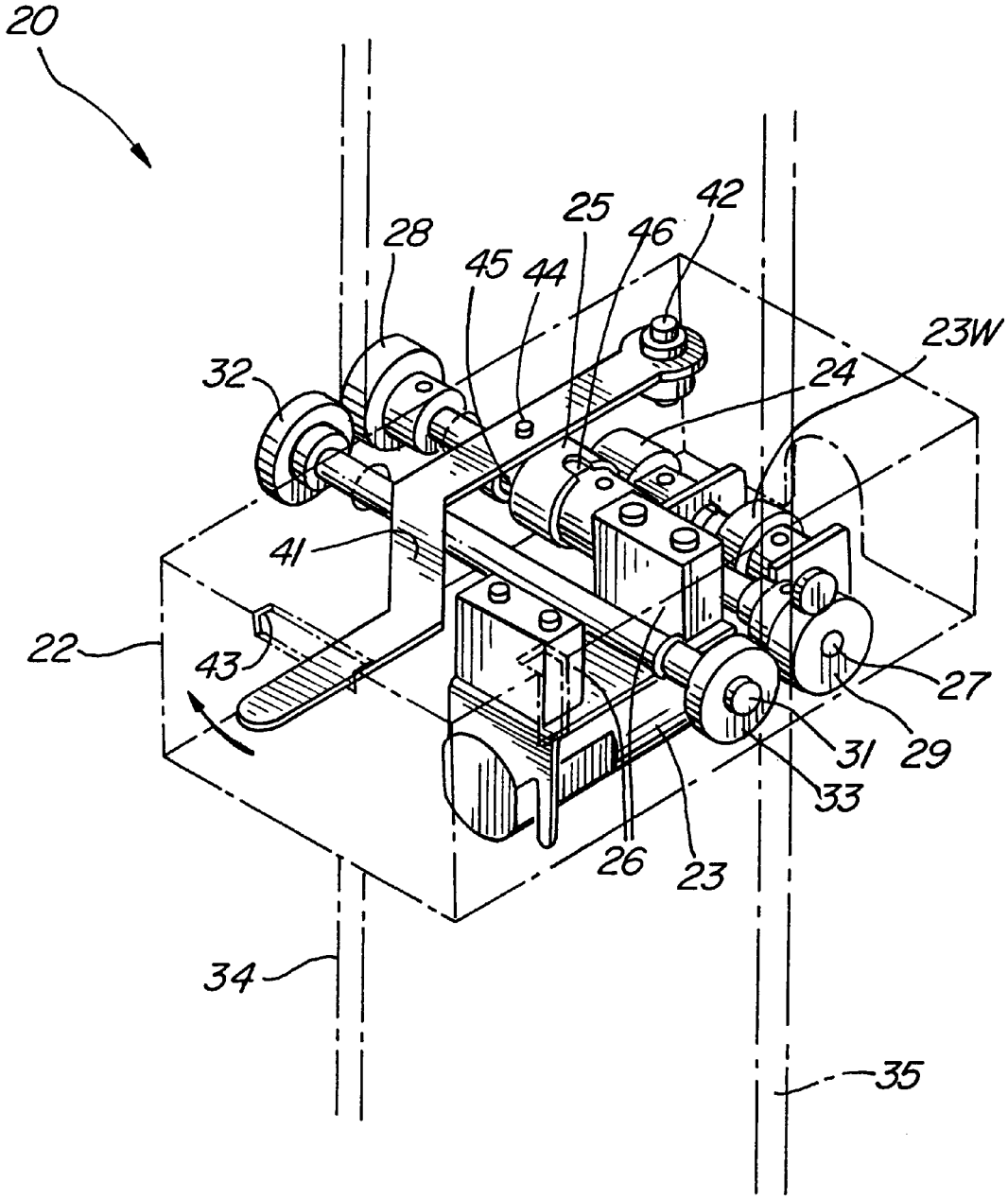
FIG. 7 is a perspective view disclosing a drive mechanism for an elevator apparatus.

Referring to FIG. 7, the elevator apparatus 20 is equipped with a case housing 22 of a box-type configuration having an aperture in its bottom. Mounting blocks 26 support a small electrical motor 23 which can drive or rotate a drive shaft 27 through a worm gear or worm wheel 23 W mechanism (not shown) and gears 24 and 25. The lever arm 41 is pivotally connected to the housing by a pivot-axis 42 back of an apical plate in the case 22. The end of the lever 41 is movably projected through an aperture or window 43 in the door 16. The lever 41 carries a pin 44 that can slideably engage with the gear 25 at its central section. When the pin 44 engages the gear 25 it can be moved along an axial direction of the drive shaft 27. A spring 45 is mounted between the drive shaft 27 and the inner wall of the case 22 and the gear 25 to thereby bias the gear 25. When the electric motor 23 is in operation, the drive shaft 27 will rotate. In this manner, the gears 28, 29 will engage with rack boards or rails 34, 35 that extend vertically on the exterior of the respective side boards 11, 12. Idler rollers 32, 33 are mounted on a shaft 31. The idler rollers 32, 33 capture the other side of the respective rack boards 34, 35. When the drive shaft 27 is engaged the gears 28, 29 are driven and the elevator can be moved vertically so that it can raise the elevator case 22. When the lever 41 is moved leftward as shown in the arrow in FIG. 7, then the gear 25 can be freed from a protrusion 46 on the drive shaft 27. When this occurs, the drive shaft 27 is freed from the worm gear mechanism and the electric motor and in essence a clutching operation has occurred wherein the drive shaft of the electric motor is taken out of engagement and the elevator apparatus 20 is thereby released. In this manner, the elevator apparatus 20 can then slide to the lowest portion of the dispensing apparatus 10.

Figure 4:
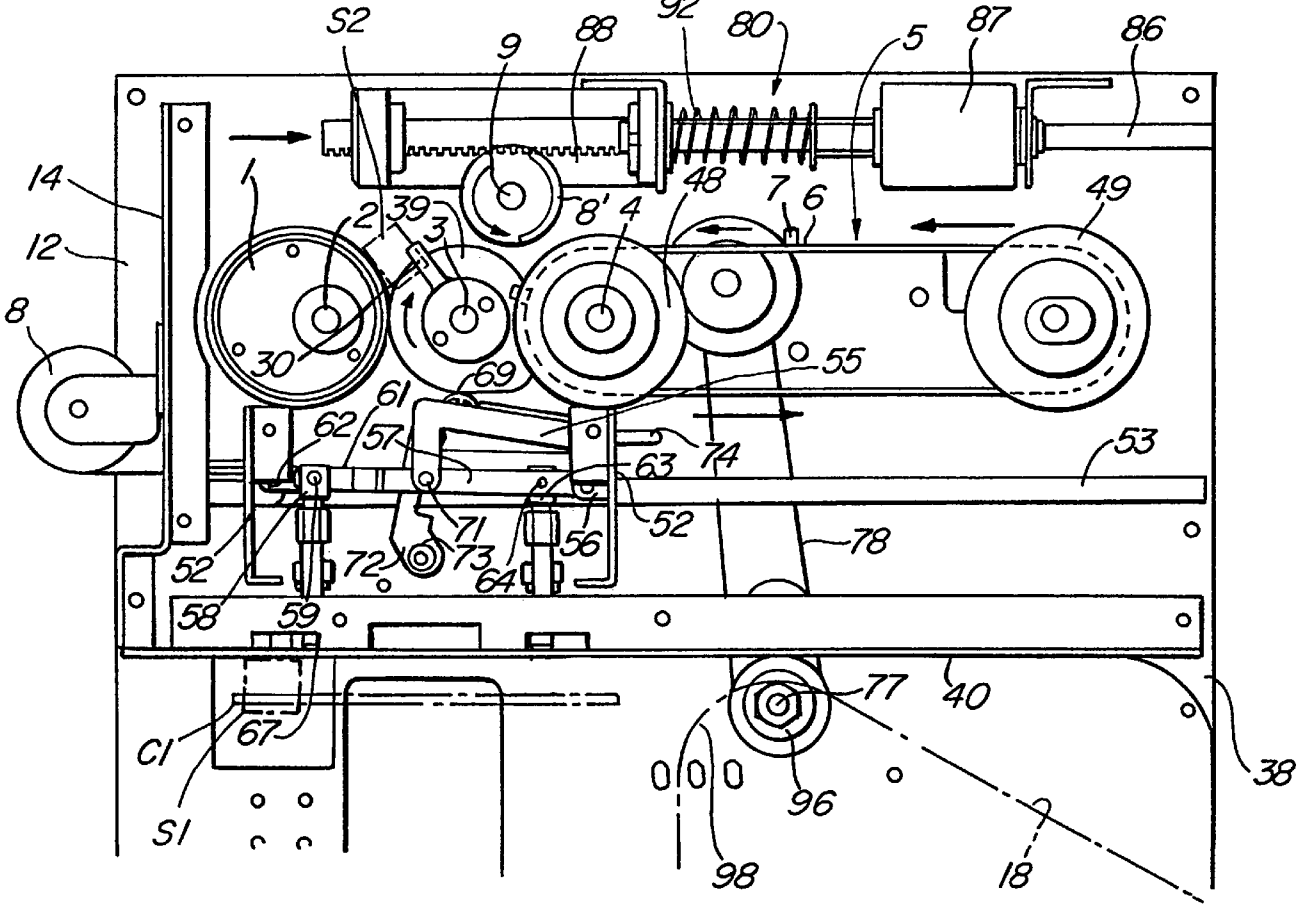
FIG. 4 is a partial side schematic view of an ejector apparatus of FIG. 1 in a load position.

By again moving the lever 41 to engage the drive shaft of the electric motor 23, the elevator apparatus 20 will then be actuated so that the gears 28, 29 will be driven and the elevator apparatus 20 will rise slowly as it progresses upward along the pair of rack boards 34, 35. This movement will continue until a top of the card body C1, as shown in FIG. 4 is detected by the sensor S1. When this card body C1 is detected, the electric motor 23 of the electric apparatus 21 will stop.

As can be further seen in FIG. 1, there is a small rectangular body which is denoted S3. S3 is a sensor that will detect the absence of any card body on the elevator apparatus 20 and can stop any further operation of the dispensing apparatus 10 with an appropriate signal to a user. The rack board 34 can be made from a resin material and can be inserted between the gear 28 and the roller 32 while the rack board 35 is inserted between the gear 29 and the roller 33. As can be appreciated, the gears can be driven by friction or an as alternative can be driven by a tooth engagement to provide a rack and pinion arrangement.

Figure 6:
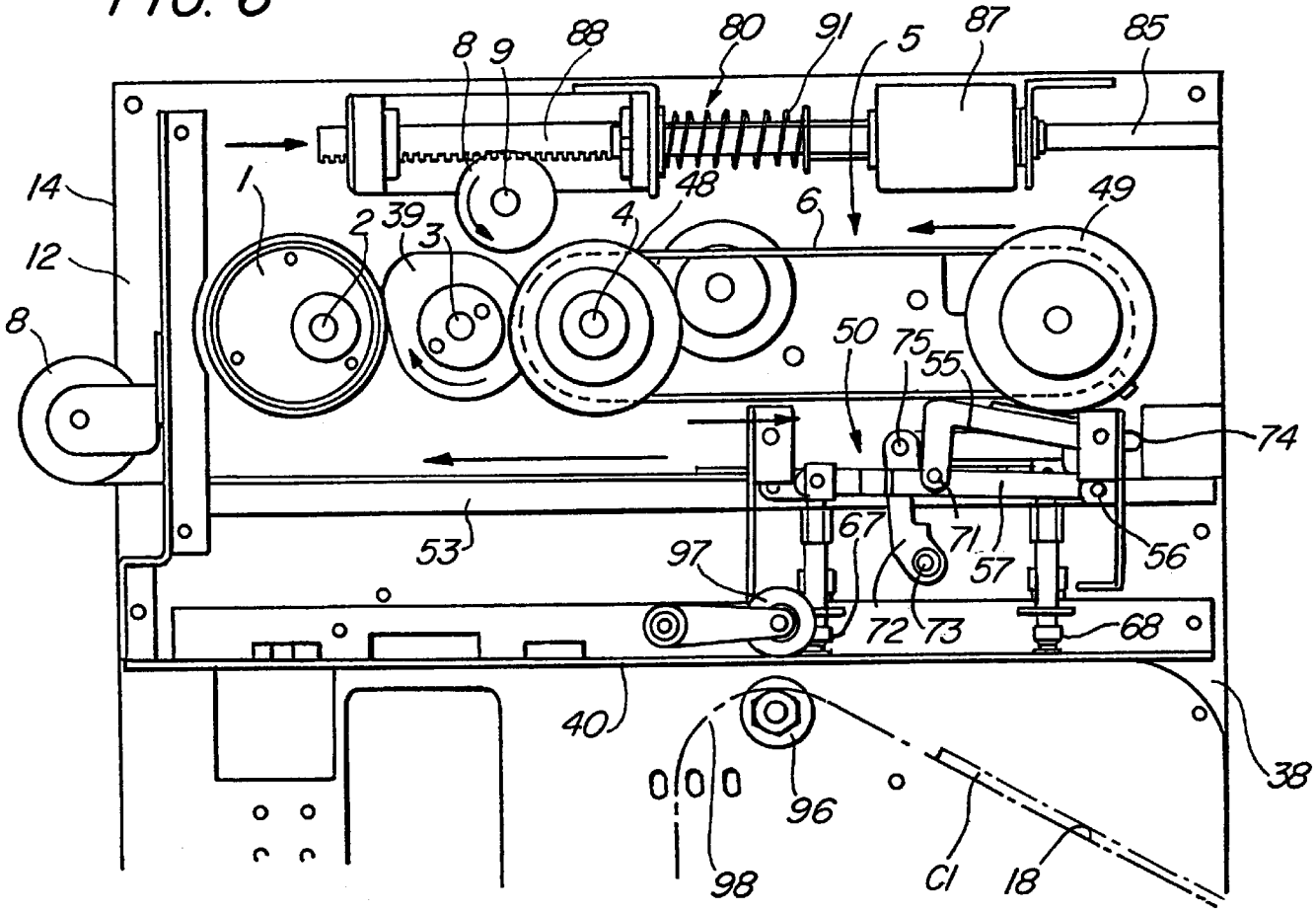
FIG. 6 is a schematic side view of the ejector mechanism of FIG. 4 in a dispensing position.

As seen in FIG. 4, a coiled helical band spring 8 is mounted on the exterior surface of the backboard 14 so that it can rotate about an axis. The spring 8 extends inward so that one end is attached to an absorber or suction mechanism 50 that can reciprocate both in a horizontal and a vertical direction from a loading station position above the stored cards C1, as seen in FIG. 4, to a discharge station as seen in FIG. 6. The flat coiled spring 8 serves to provide a biasing mechanism to retract the absorber 50 from the discharge station to be positioned once again above the loading station.

Figure 8:
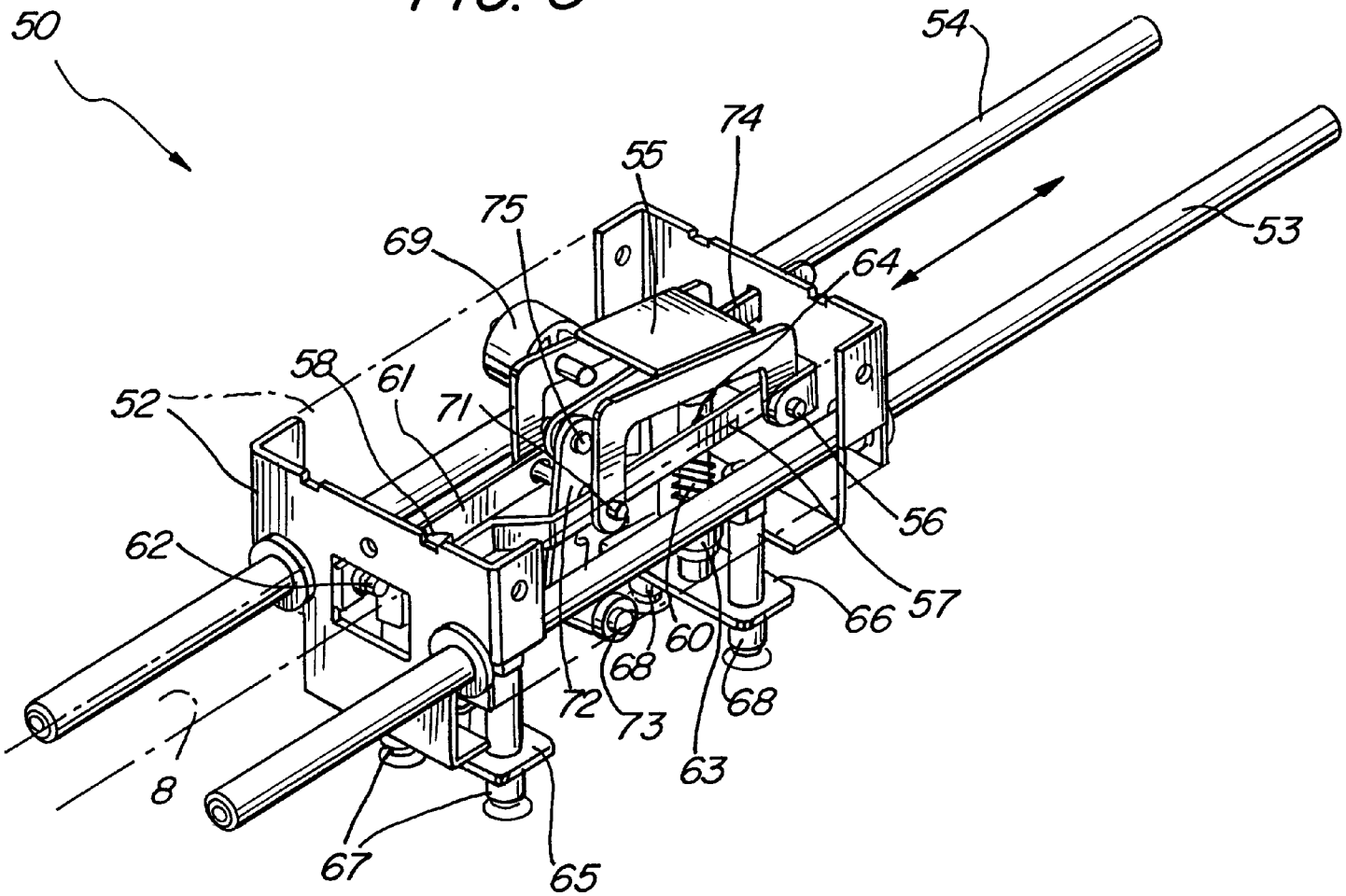
FIG. 8 is a general perspective view showing an arrangement for operating suction nozzles.

The absorber 50 can be seen in isolation on FIG. 8 and serves the function of an unload assembly. The absorber 50 has a relatively rectangular shaped housing or case 52 with an open upper aperture. The case 52 is appropriately apertured with bearings so that it can move left and right from a load station to the discharge station in a slideable fashion along a pair of horizontal rails 53, 54 that extend parallel to the sideboards 11, 12. The pair of horizontal rails 53, 54 can be arranged between the rectangular frontboard 13 and the backboard 14. Thus the discharging apparatus of the present invention will be operative between the frontboard 13 and the backboard 14 for discharging the card bodies 10. Mounted within housing or case 52 is a linkage arrangement that enables a vertical movement of two pairs of suction disk nozzles 68, 67. The suction disk nozzles 68, 67 or pickup members have the capacity to attach themselves to the upper surface of the card body 10 at the loading station and then subsequently to release the card body 10 at a discharge station. As can be appreciated, the card bodies 10 are initially moved upward and therefore are simply lifted off of the lower stacked arrangement of card bodies. There is no sliding frictional or horizontal movement or displacement that traditionally occurs in a stacked arrangement of card-like objects, wherein the lower-most card member is usually forced laterally outward from the bottom of the stack with the stack of card-like members being fed by a gravity feed.

Figure 5:
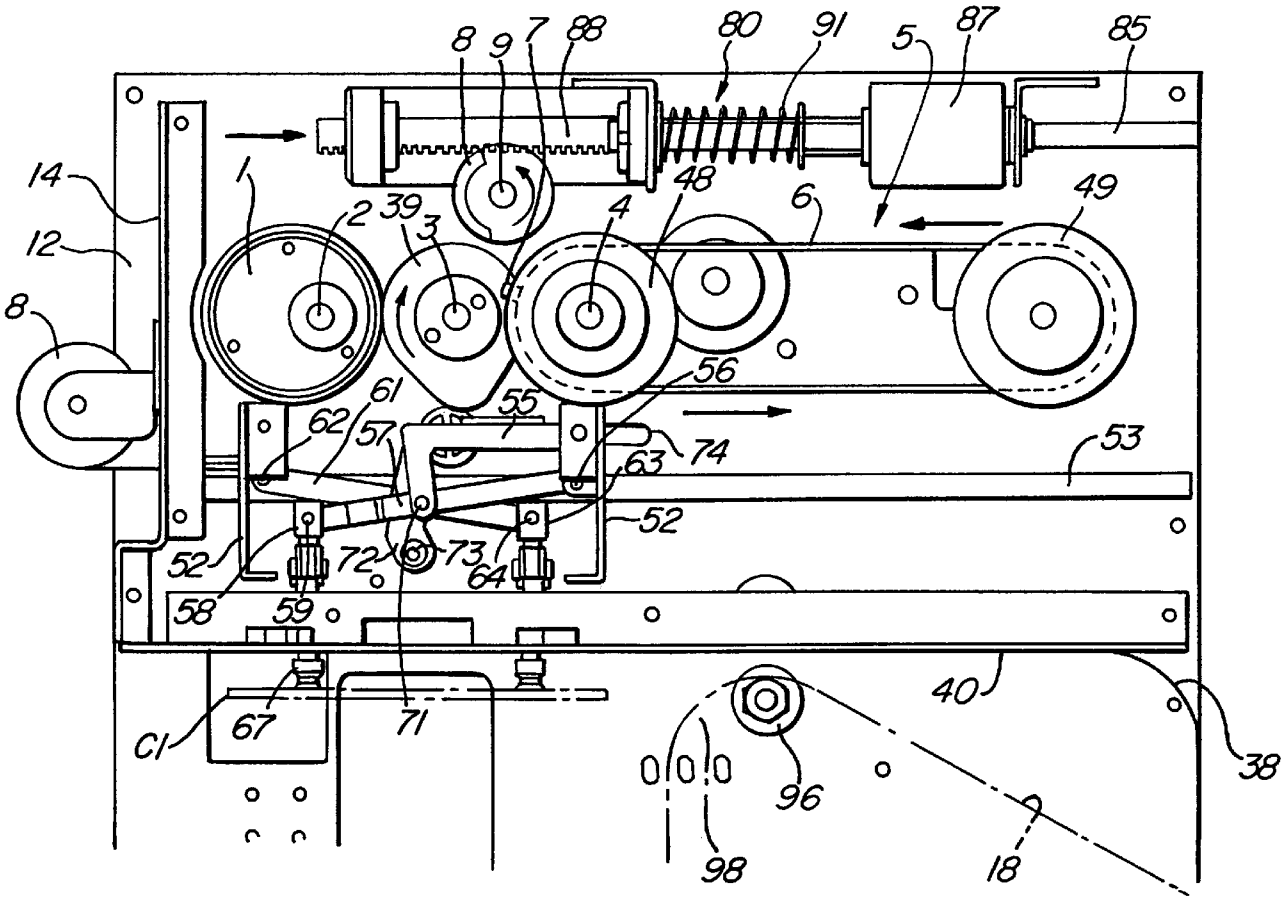
FIG. 5 is a partial schematic view of the ejector mechanism of FIG. 4 in an activated state.

Referring to FIG. 8, a housing or operation body 55 has generally an H-shape in a plan view. The four legs of the operation body 55 are bent downward wherein a pair of the legs mount a pivot axis 56 which is attached to a lever member 57. One end of the lever 57 mounts the pivot axis 56, for example as seen in FIG. 5, while the other end of the lever 57 mounts a pivotal shaft 59 to provide an elevating axis 58. A scutellum 65 or shield-like structure is fixed to a projection portion of the lower part of the elevation shaft 58. The shield-like structure 65 is, in turn, fixed to a pair of suction disk nozzles 67. Another lever 61 is mounted to a pivot axis 62 at the other side of the case housing 52. The lever 61 is mounted to pivot about the axis 62 and is mounted at its other end with an elevation shaft 63 at the pivot axis 64. A second scutellum or shield-like member 66 is fixed to a projection portion of the lower part of the elevation shaft 63. The scutelum 66 fixes a second pair of suction disk nozzles 68. A pair of elevation shafts 58, 63 are operatively connected or mounted with a spring 60 in the inner side of the case 52. As shown FIG. 8, the spring 60 of the elevation shaft 63 is shown in partial view. An axis 71 is arranged as a pivot-axis on the other legs of the operational body 55. The axis 71 penetrates slideably inside an oblong hole open in the center section of each of the pair of levers 57, 61.

A hook-piece member 72 of a C-type configuration can be mounted to the pivot axis 73 in the center of the bottom of case 52. This hook piece 72 can be energized or biased by a spring not shown. A long operating rod 74 is mounted to a pivot axis 75 in the upper end of a hook piece 72. The other end will project moveably from the case housing 52. A roller 69 can be readily attached to the operation body 55 and can be used to depress against the spring 60 as shown in FIGS. 4–6. Thus, as seen, the roller 69 can interact with a cam member 39 and by its movement the respective levers 61, 57, which form a linkage assembly, can be forced downward against the action of the springs and the corresponding suction nozzles 67, 68 can thereby be forced to come into engagement with an upper surface of a card member C1. (See FIG. 5) When the cam 39 is further moved the suction nozzles 67, 68 can be elevated upward to lift the card member off of its stacked array or off of the elevator 20.

Figure 9:
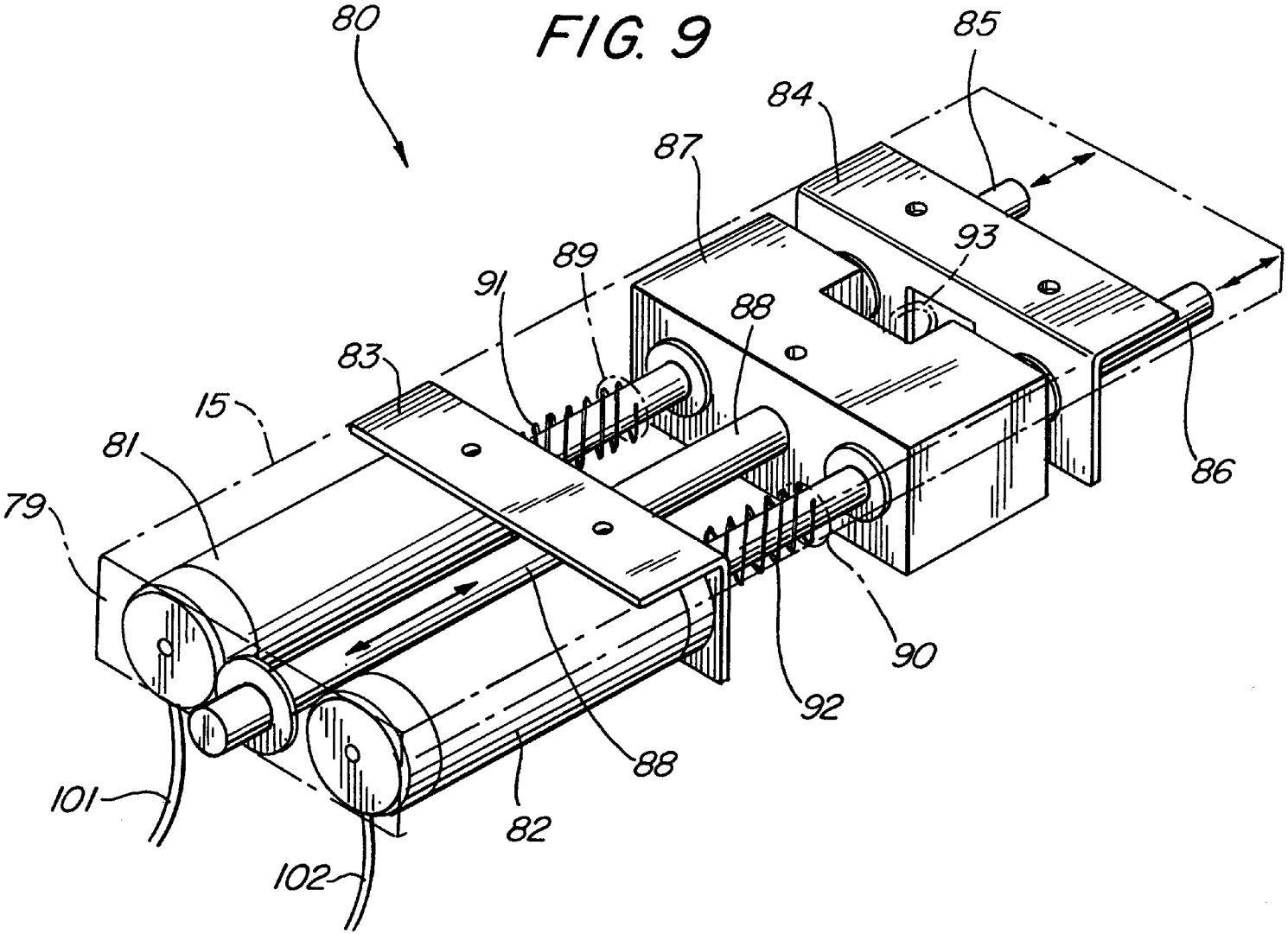
FIG. 9 is a perspective view of a mechanism for generating a suction force.

The roller 69, rotatably attached by the operation body 55, is depressed against the spring 60 acting on the elevation shafts 58, 63. The spring of the hook piece 72 will first operate and the hook piece 72 will engage with the pivot axis 71 to stop in an engagement condition, as shown in FIG. 5. When the roller 69 is depressed, the four suction disk nozzles 67, 68 will lower and if the roller 69 is set free, the spring 60, etc. will affect a restoration and the suction disk nozzles 67, 68 will rise. When the hook piece 72 engages at axis 71, it will stop and, therefore, the position of the suction disk nozzles 67, 68 will be maintained as shown in FIG. 5. Mounted on the under side of the top plate 15 is an air cylinder suction apparatus to be able to provide a self-contained source of low atmospheric pressure to the respective section nozzles 67, 68. Reference can be had to FIG. 9 the air cylinders 81, 82 are connected respectively to a pair of air hoses or tubes 101, 102. The air cylinders 81, 82 are fixed to a mounting curvature piece 79 at one end of the top plate 15 and are mounted at the other end to a bottom plate 83 attached to the top plate 15. A guide plate 84 is also attached to the top plate 15 and has apertures for receiving in a sliding manner the respective piston shafts 85, 86 of the cylinders 81, 82. A U-shaped block 87 is slideably mounted to the center of the pair of piston shafts 85, 86. A rack member 88 extends through the attachment member 83 and the mounting curvature piece 79. The end of the rack 88 is fixed by the block 87. A pair of stoppers 89, 90 are fixed onto the center section of the piston shafts 85, 86, respectively. Additionally, a pair of springs 91, 92 are mounted about the respective shafts 85, 86. Thus the spring 91 is mounted to the piston shaft 85 between the stopper 89 and the bottom plate 83. Additionally, a spring 93 is arranged between a mounting hook 94 attached to the top plate 15 and the block 87. As a result, if the rack rod 88 is pulled to the left hand side of FIG. 9, against the springs 91, 92, 93, the piston shafts 85, 86 will be inserted into the cylinders 81, 82 by the block 87. If the rack rod 88 is released, then the forces of the springs 91, 92, 93 will go into effect. Consequently, if the block 87 is reset to an original position, then air of low atmospheric pressure will exist in the tubes 101, 102 and air will be drawn inward into the respective cylinders. The respective tubes 101, 102 are connected with the four suction disk nozzles 67, 68.

In operation, the electric motor 23 and the elevator apparatus 20 can be activated, for example, by a controller circuit or a microprocessor control unit A, so that the gears 28, 29 will rotate and the elevator apparatus 29 will raise along the pair of rack boards 34, 35 to position a card member C at a load position. The top of the card body C1, as can be seen in FIG. 4, can be detected by the sensor S1. The sensor S1 will stop the elevator motor and consequently, the elevator apparatus 20. Thus, the elevator apparatus is providing a standby condition and has enabled a card body to be positioned for discharge. When a start button (not shown) of the discharged apparatus 10 is switched on the electric motor 1 will operate so that the cam shaft 3, the belt shaft 4, the gear shaft 9 and the roller shaft 77 will be rotated, along with the gears and belt 78, such as shown in FIG. 4. When the gear shaft 9 rotates, as seen in FIG. 4, the gear portion 8 will engage with the rack rod 88. In this manner, the block 87 and the shafts 85, 86 will move leftward in FIG. 9 against the force of the springs 91, 93. When the belt shaft 4 rotates, the belt 6 which is made from a flexible resin material with a outstanding protrusion 7 will also rotate. The belt 6 will rotate counter-clockwise within the pulleys 48, 49. When the cam shaft 3 rotates, the cam 39 that is co-axially connected with the cam shaft 3 and made from rubber will rotate clockwise. The cam 39 will react with the follower 69 in the form of the roller and will depress the operation body 55 as shown in FIG. 5. As a result, the four suction disk nozzles 67, 68 will be expended downward vertically to contact the upper surface of the card body C1. In FIG. 5, the rack rod 88 of the suction air cylinder apparatus 80 will separate from contact with the partially open section of the gear member 8 prime and therefore freeze the rack rod 88 permits the spring 91, 92, 93 to effect the restoration, block 87 moves in the right hand side of FIG.

8 so that the piston shafts 85, 86 are extracted from the cylinders 81,82. This provides a low atmospheric condition so that the tubes 101, 102 will suck air. Consequentially, the four suction disk nozzles 67, 68 are contacted to the card body C1 will adhere to the card body C1 and hold the card body fast.

In addition, when the cam shaft 3 rotates further, the cam 39 will separate from the roller 69. However, the hook piece 72 hangs on the pivot axis 71 of the operation 55 and is stopped. For this reason, the condition of FIG. 5 is maintained. As the belt 6 of the conveyor 5 rotates, the protrusion 7 will approach the suction absorber apparatus 50 and a projection end of the operating rod 74 will strike a stopper 70 on the rectangular body. Simultaneously, the hook piece 72 separates from the axis 71. Consequentially, the spring 60 affects the restoration. Therefore, the four suction disk nozzles 67, 68 rise and the card body C1, sucked by the suction disk members 67, 68 can be removed so that the card body C1 will drop into the position shown in FIG. 6. The card body C1 can be forcibly removed by the pair of frame members 40 that are arranged on the inner wall of the side plates 11, 12 as seen in FIG. 6. The card body C1 will then contact and slide down a receptacle 18 having a sufficient slope to permit gravity to eject the card body C1. A triangular guideboard 38 is suspended above the receptacle 18 to guide the leading edge of the card body C1 so that there is no hang up in its discharge.

The four suction disk nozzles 67, 68 will rise upward. The protrusion 7 of the belt 6 will then separate from the opening edge of the case 52 and thereby free its connection to the suction absorber apparatus 50. The absorber apparatus 50 is then returned to its original position above the load station, as shown in FIG. 4, as a result of the restoration of the flat band spring 8. The card body C1 that has been released from the suction absorber apparatus 50 is guided by the guide section 98 so that the card body slides in the direction of the receptacle 18 away from the accommodation chamber 99 of the elevator apparatus 20. A sending roller 96 that is driven by the belt 78 from the pulley as a result of the rotation of the roller shaft 77 can provide an ejection force to the card body C1. As seen in FIG. 6, a pressure foot roller 97 can assist in any release of the card body if necessary. The sending roller 96 has a unidirectional clutch function.

When the suction absorber apparatus 50 is returned to its original position, the protrusion 30 of the cam shaft 3, as shown in FIG. 4, passes a sensor S2 and is detached whereby the electric motor 1 is then stopped. This is the state that exists in FIG. 4. As can be appreciated, the positioning of the protrusion 30 on the cam shaft 3, the shape of the cam 39 and the projection 7 of the belt 7 are appropriately positioned to provide for discharge of a card body C1.

Referring to FIG. 3, there is an accumulation chamber 21 that longitudinally extends adjacent the front portion of the sideboards 11, 12. This longitudinal chamber can be utilized to contain wiring used for the electrical motor 23 of the elevator apparatus 20. Additionally, a conveyor 5 uses a belt made from resin 6 with the projection 7. However, other force generating arrangements can be made that can be tied in, for example, to the movement of the piston shafts 85, 86 of the cylinders 81, 82. Additionally, a plunger which performs a reciprocating motion, with an electric solenoid, can be used instead of the belt 6. While the power transmission of the electric motor 1 can use many gears, it is also possible to use other arrangements for transmission of power, such as a pulley and belt arrangement.

The preferred embodiment of the present invention shows two air cylinders 81, 82. However, it is also possible to adapt one air cylinder to be used for such purposes.

The controller circuit A, shown in FIG. 1, can control the timing of the operation of the elevator apparatus, conveying apparatus, and air cylinder suction apparatus in coordination with the user's introduction of a predetermined sum of money or token into the vending apparatus, as is well known in the vending industry. The controller circuit A can be mounted beneath the bottom board 19 to provide easy access for servicing and can include a microprocessor based circuit to provide coordinating of each component in the dispensing apparatus module The present invention permits the adhesion of a relatively thick card body from the top of a stack with the card body then being transferred from a load position to a discharge position. The card body can then be reliably ejected without being damaged. As a result of this self-contained adhesion to a thick card body and translation from a load station to a discharge station, advantages can be achieved that have not been hereto available in this art.

Those skilled in the art will appreciate that various adaptations and modifications of the just-described preferred embodiment can be configured without departing from the scope and spirit of the invention. Therefore, it is to be understood that, within the scope of the appended claims, the invention may be practiced other than as specifically described herein.

What is claimed is:

1. In a dispensing apparatus for dispensing articles in a stack array in a vending machine, the improvement of an elevator apparatus for movingly supporting the stack array of articles comprising:

a rack member extending vertically in the dispensing apparatus;

a housing structure for supporting the stack array of articles;

a drive member for engaging the rack member;

a drive shaft extending from the housing structure and connected to the drive member;

a drive source connected to the drive shaft; and a clutch member that can disconnect the driving of the drive member to enable the housing structure to be positioned at a lower portion of the rack member for loading articles on the housing structure.

2. The invention of claim 1, wherein the clutch member is pivotably mounted and is accessible to an operator to enable loading of articles.

3. The invention of claim 1, wherein a pair of rack members are provided, one on either side of the housing structure, and a pair of drive members are provided, one on each side of the housing structure, for engaging a respective rack member.

4. The invention of claim 1, wherein the housing structure has an upper flat surface which extends over the drive source and drive shaft.

5. The invention of claim 1, further including a first sensor member for determining the position of an uppermost article in a stack on the housing structure.

6. The invention of claim 1, further including a second sensor member for determining when no articles are on the housing structure.

7. The invention of claim 1, further including an unload assembly for removing articles from the elevator apparatus.

8. The invention of claim 7, wherein the unload assembly includes a suction nozzle which removably engages an uppermost article.

9. The invention of claim 8, further including a source of below atmospheric pressure connected to the suction nozzle.

10. The invention of claim 8, further including a linkage assembly that can activate the suction nozzle to be lowered to contact the article and subsequently raise the suction nozzle to lift the article off of the elevator apparatus.

11. A dispensing apparatus module for dispensing articles in a stacked array and mountable in a vending machine, comprising:

a rack member;

an elevator apparatus for supporting the articles and lifting them to a load station including a drive member on the elevator apparatus for engaging the rack member and a clutch member that can disengage the drive member;

an openable cover member for permitting an operator to load articles to be dispensed on the elevator apparatus;

a conveying apparatus for removably engaging an uppermost article to lift it off of the elevator apparatus at the load station and to translate the article to a discharge station; and a controller circuit for causing the conveying apparatus to removably engage the uppermost article at the load station and to disengage the article at a discharge station, wherein the article is delivered to a discharge tray for the user.

12. The dispensing apparatus module of claim 11, further including a suction nozzle on the conveying apparatus for engaging an article and a source of below atmospheric pressure connected to the suction nozzle.

13. The dispensing apparatus module of claim 12, wherein the source of below atmospheric pressure includes a cylinder and a spring biased piston.

14. The dispensing apparatus module of claim 12, wherein the conveying apparatus includes a linkage assembly for movably mounting the suction nozzle to extend from and be retracted to the conveying apparatus when engaging the article.

15. The dispensing apparatus module of claim 14, further including a cam member for contacting the linkage assembly at the load station and extending the suction nozzle.

16. The dispensing apparatus module of claim 12, further including a belt conveying mechanism for driving the conveying apparatus from the load station to a discharge station.

17. The dispensing apparatus module of claim 12, further including a biased spring mechanism for returning the conveying apparatus from the discharge station to the load station.

18. A dispensing apparatus module for dispensing articles in a stacked array and mountable in a vending machine, comprising:

an elevator apparatus for supporting the articles and lifting them to a load station;

an openable cover member for permitting an operator to load articles to be dispensed on the elevator apparatus;

a conveying apparatus for removably engaging an uppermost article to lift it off of the elevator apparatus at the load station and to translate the article to a discharge station further including a suction nozzle for engaging an article and a source of below atmospheric pressure connected to the suction nozzle including a cylinder and a spring biased piston; and a controller circuit for causing the conveying apparatus to removably engage the uppermost article at the load station and to disengage the article at the discharge station, wherein the article is delivered to a discharge tray for the user.

19. A dispensing apparatus module for dispensing articles in a stacked array and mountable in a vending machine, comprising:

an elevator apparatus for supporting the articles and lifting them to a load station;

an openable cover member for permitting an operator to load articles to be dispensed on the elevator apparatus;

a conveying apparatus for removably engaging an uppermost article to lift it off of the elevator apparatus at the load station and to translate the article to a discharge station including a suction nozzle for engaging an article and a source of below atmospheric pressure connected to the suction nozzle, and a belt conveying mechanism for driving the conveying apparatus from the load station to a discharge station; and a controller circuit for causing the conveying apparatus to removably engage the uppermost article at the load station and to disengage the article at a discharge station, wherein the article is delivered to a discharge tray for the user.

* * * * *